US006859124B2

(12) United States Patent
Nishimizu et al.

(10) Patent No.: US 6,859,124 B2
(45) Date of Patent: Feb. 22, 2005

(54) GAS INSULATION TRANSFORMER

(75) Inventors: Akira Nishimizu, Hitachi (JP); Youichi Amako, Niigata (JP); Takahide Matsuo, Naka (JP); Noriyuki Hayashi, Hitachinaka (JP); Takashi Shirone, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 79 days.

(21) Appl. No.: 10/066,458

(22) Filed: Jan. 31, 2002

(65) Prior Publication Data

US 2003/0080841 A1 May 1, 2003

(30) Foreign Application Priority Data

Nov. 1, 2001 (JP) ..... 2001-336181

(51) Int. Cl.[7] ..... H01F 27/08
(52) U.S. Cl. ..... 336/55; 336/90
(58) Field of Search ..... 336/55–62, 90–96, 336/219, 233–234

(56) References Cited

U.S. PATENT DOCUMENTS 5,736,915 A * 4/1998 Goedde et al. ..... 336/55

FOREIGN PATENT DOCUMENTS

| | | | |
|---|---|---|---|
| JP | 61-190910 | * | 8/1986 |
| JP | 9-7843 | * | 6/1995 |
| JP | 10-189348 | * | 7/1998 |
| JP | 2000-150253 A | | 5/2000 |

OTHER PUBLICATIONS

Journal of the Japan Electric Association ISSN 0387–0758 pp. 6–9 (1998).

Institute of Electrical Engineers of Japan Technical Report No. 459 pp. 30–32 (1993).

* cited by examiner

*Primary Examiner*—Tuyen T. Nguyen
(74) *Attorney, Agent, or Firm*—Townsend and Townsend and Crew LLP

(57) ABSTRACT

A gas insulation transformer, in the tank of which transformer an apparatus including an iron core and a coil is received and a gas is filled as an insulating and cooling medium, is provided, wherein the iron core and coil are possessed with the loss characteristics equivalent to that of a high-efficient transformer and an inert gas, the global warming coefficient of which gas is rated 1 or below, is filled in the tank as an insulating and cooling medium.

2 Claims, 4 Drawing Sheets

MIXING RATIO PARTIAL DISCHARGE CHARACTERISTICS (KRAFT PAPER)

GAS INSULATION TRANSFORMER

FIELD OF THE INVENTION

The present invention relates to a gas insulation transformer, especially pertaining to the gas insulation transformer, in the tank of which transformer a gas is sealed, the global warming coefficient of which gas is rated 1 or below.

DESCRIPTION OF THE RELATED ART

It often happens that flame retardant or incombustible characteristics are required for a transformer installed in a building, an underground substation and so forth. As an example of such incombustible type of transformer as mentioned above, a gas insulation transformer in which an incombustible gas is sealed, which gas is mostly centered on sulfur hexafluoride (hereinafter, referred to as $SF_6$ gas). This is, viewed from an electrical point, due to the fact that the dielectric strength of the $SF_6$ gas is approximately 2.6 times as large as that of the air under atmospheric pressure while being extremely stable in heating and chemical characteristics, wherein it is stable even at 500 degrees Centigrade under noncatalytic condition.

Hereafter, one example of the prior art is described with reference to FIG. 4.

FIG. 4 shows a partly sectional side view of the prior gas insulation transformer. $SF_6$ gas is sealed in a tank 3 thereof that is provided wish a waveform rib 5 for cooling. This gas is sealed under the application of pressure in the tank so as to enhance the cooling and insulating characteristics thereof. The tank 3 is arranged such that it well stands the compressed sealing of the gas 19.

An iron core 1 and a coil 2 are received in the tank 3. In the event that a silicone steel plate is adopted as a material for the iron core, it is arranged such that a coating operation is performed on the cut or lamination surface thereof. This is due to the following reason.

Where a metallic material exists in the $SF_6$ gas, the material begins to be dissolved at the temperature more than 200 degrees Centigrade, which dissolution is further promoted with the existence of water content. As mentioned in the technical report No.459 issued by the Institute of Electrical Engineers of Japan, where there exist water content and silicone steel plate therein, silicon Si works as a catalyst so as to bring about hydrolysis at the temperature between 150 to 200 degrees Centigrade, the chemical formula of which is shown in the following representation (1).

$$2SF_6+6H_2O \rightarrow 2SO_2+12HF+O_2 \quad (1)$$

Hydrolysis generates sulfur dioxide gas $SO_2$ and hydrogen fluoride gas HF, as the countermeasure against which a coating operation is performed on the no-filmed lamination surface of the iron core 1 of the $SF_6$ gas 19 sealed insulation transformer.

Further, the $SF_6$ gas generates such dissolved gas as hydrogen fluoride gas HF, sulfur tetrafluoride gas $SOF_4$ or sulfur dioxide gas $SO_2$ under arc discharge or partial discharge. The hydrogen fluoride gas HF causes asphyxiation and highly irritating odor, the contact with which gas causes the skin and the eyes to be contaminated while the inhalation of which gas causing the respiratory organ to be damaged. Moreover, the sulfur dioxide gas $SO_2$ likewise causes strong irritating odor, the inhalation of which gas to high degree causes the lungs to be damaged. Accordingly, on safety and hygienic grounds, it is undesirable to let go of such gasses as mentioned above in the atmosphere.

As the countermeasure against such inconveniences as described above, it is usual in many cases that the $SF_6$ gas sealed insulation transformer is structurally arranged free from corona discharge, and is incorporated with an absorbent of the dissolved gasses. It is further required that the hazardous gasses be prevented from escaping into the atmosphere when the internal system becomes out of order. Therefore, the tank 3 is arranged such that it well stands the compressed sealing of the gas 19 as well as the increase of the internal pressure thereof when it is out of order. Otherwise, a bursting valve 9 and a depressurizing tank 20 are provided therewith so as to prevent the hazardous gasses as dissolved therein from escaping into the atmosphere.

As another prior example, a tank is disclosed in the Japanese Patent Application Laid-open No.2000-69631, which tank is provided with a mechanism wherein a nitrogen gas filled bag is connected to the bursting valve, which bag is provided in the tank, so as to let go of only nitrogen gas into the atmosphere upon the operation of the bursting valve triggered by the increase of the internal pressure thereof when it is out of order. To note, in FIG. 4, reference numerals 6, 7 and 8 indicate a compound gauge to measure the positive or negative pressure of the internal gas, a first terminal and a second terminal, respectively.

Further, the Japanese Patent Application Laid-open No.2000-150253 discloses a transformer that adopts the $F_3I$ gas or a mixture containing the same gas that is small in the global warming coefficient as an insulating and cooling medium.

However, at the 3$^{rd}$ Session of the Conference of the Parties to the United Nations Framework Convention on Climate Change: COP3, held in Kyoto on December in 1997, in which an emission reduction target for the respective greenhouse effect causing gasses has been defined, which gasses include $SF_6$ gas besides $CO_2$, $CH_4$, $N_2O$, HFC and PFC. As described above, the $SF_6$ gas is chemically stable, the lifetime of which lasts 3,200 years in the atmosphere, and is highly capable of absorbing infrared rays, the global warming coefficient of which is 23,900 times as large as that of $CO_2$. According to the November 1998 issue of the Electrical Society magazine, it is reported that the gas insulation equipment annually discharge $SF_6$ gas in the order of 50 tons upon inspection and in the order of 10 tons upon demolition while annually leaking the same in the order of several tons. The same situation naturally applies to the $SF_6$ gas sealed insulation transformers upon the inspection and demolition thereof. Thus, the use of $SF_6$ gas in general is large setback against the protection of the global environment.

Then, a coating operation is required for the iron core 1 of the $SF_6$ gas 19 sealed insulation transformer so as to prevent the material of the core from acting as a catalytic metal for hydrolysis, which hampers the streamlining of the production steps. Likewise, the fact that the $SF_6$ gas sealed in the tank 3 is compressed requires that the tank be structurally sturdy against such high internal pressure, which tank should be arranged further sturdy in structure taking into considerations upon the increase of the internal pressure thereof when it is out of order, so as to prevent the hazardous gasses from discharging into the atmosphere under arc discharge or partial discharge. Otherwise, it is arranged that a depressurizing tank 20 together with a bursting valve 9 are provided therein for the purpose of stopping the hazardous gasses from leaking into the atmosphere. This causes the weight and the production cost of the gas insulation transformer to increase.

A forced-air-cooled transformer is disclosed in the Japanese Patent Application Laid-open No.2000-150253, which transformer requires a cooling device.

SUMMARY OF THE INVENTION

The present invention is to provide a gas insulation transformer that contributes to the protection of the global environment and is light in weight and low in production cost.

The self-cooled gas insulation transformer according to the present invention comprises an apparatus including an iron core and a coil wound around the iron core, a tank receiving the equipment therein and an inert gas filled in the tank as an insulating cooling medium, the global warming coefficient of which gas is rated 1 or below.

Alternatively, the insulating and cooling medium filled in the tank may be an inert gas, the molecular weight of which gas is less than 146.

Alternately, the insulating and cooling medium may be any one of nitrogen gas, carbon dioxide gas and dried air or a mixed gas thereof.

Alternatively, the iron core and the coil are possessed with the loss characteristics of a high-efficient transformer while an inert gas, the global warming coefficient of which is rated 1 or below, is adopted for the insulating and cooling medium.

Further, the iron core is made of an amorphous metallic thin band.

Moreover, the insulating and cooling medium may be any one of nitrogen gas, carbon dioxide gas and dried air or a mixed gas thereof while the iron core is made of any one of a magnetic domain control silicone steel, a silicone steel of high orientation and an amorphous alloy.

The sealed internal pressure of the gas is less than 0.2975 Mpa (2 $Kg/cm^2G$), which pressure is not subject to the restriction for a pressure vessel corresponding to JAPAN INDUSTRY STANDARD B8265.

Additionally, the sealed internal pressure of the gas is rated 150.358 kPa or below.

Additionally, the iron core is made of an amorphous alloy.

In addition, the nitrogen gas sealed in the tank is rated 150.358 kPa or below.

These and other objects, features and advantages of the invention will be apparent from the following more particular description of preferred embodiments of the invention, as illustrated in the accompanying drawings.

DESCRIPTION OF THE PREFERRED EMBODIMENTS

Hereinafter, the preferred embodiments of the present invention are described with reference to the accompanying drawings.

Figure 1:
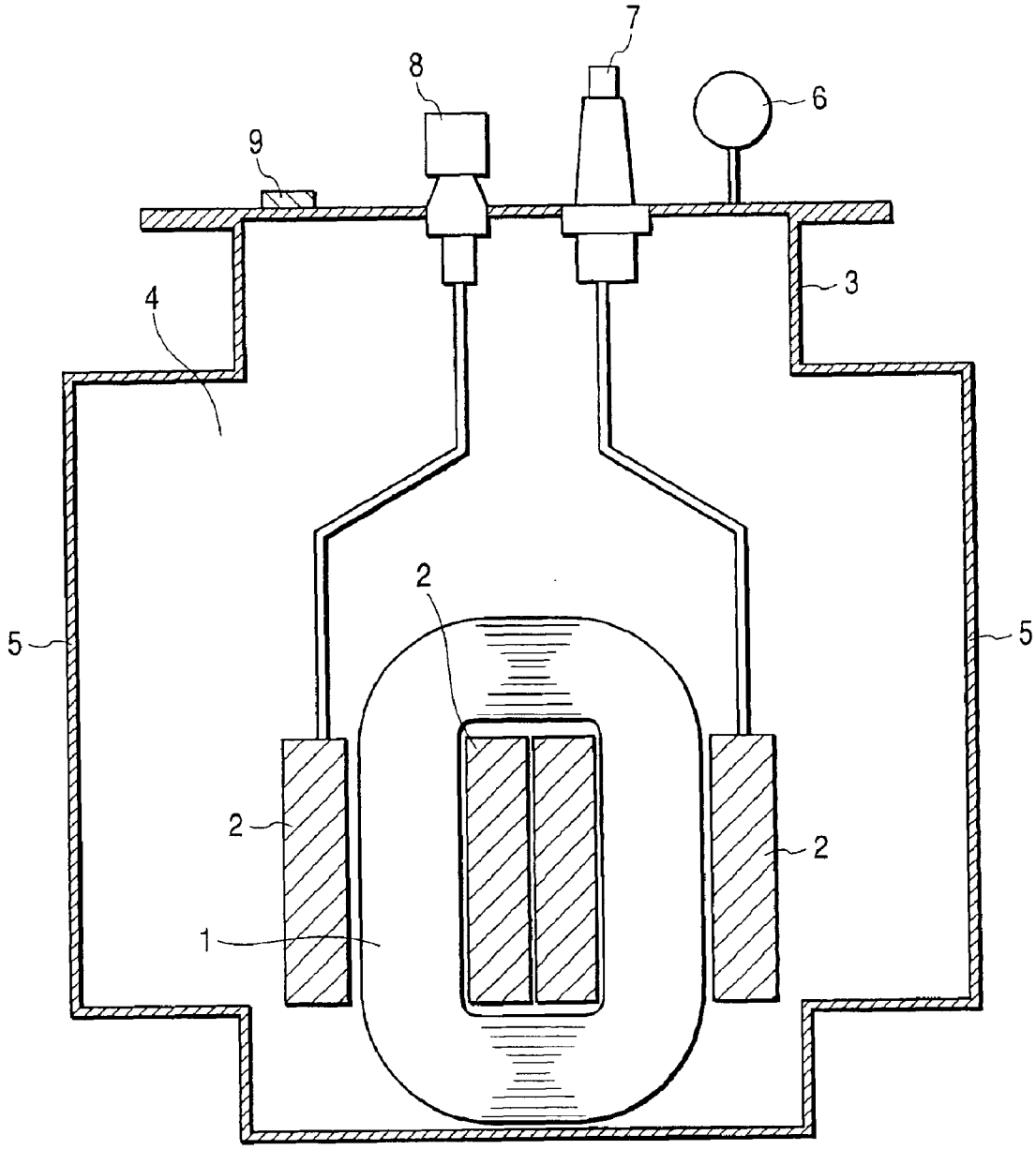
FIG. 1 is a partly sectional side view of a gas insulation transformer, which is one example of the present invention.

FIG. 1 shows a partly sectional side view of a gas insulation transformer, which is one example of the present invention. The transformer as shown in the drawing is a self-cooled 6 kV gas insulation transformer, the insulating and cooling gas of which transformer is nitrogen gas (hereinafter, referred to as $N_2$ gas). The $N_2$ gas 4 is filled in a tank 3 of the transformer as shown, which gas is sealed in the tank under the application of pressure less than 0.2975 Mpa (2 $kg/cm^2G$), preferably, under the pressure at 150.358 kPa or below. An iron core 1 and a coil 2 that are possessed with the loss characteristics of a high-efficient transformer are received in the tank 3. The tank 3 is provided with a waveform rib 5 for cooling in the same way as an oil-contained transformer. On the upper part of the tank, a compound gauge 6, a first terminal 7, a second terminal 8 and a bursting valve 9 are provided. To note, the first and second terminal 7 and 8 may be provided on the side surface of the tank 3.

The operation of the gas insulation transformer according to the present embodiment as arranged above is described below. The cooling of the iron core 1 and the coil 2 is carried out such that the temperature of the $N_2$ gas 4 rises by the transmission of the heat from the iron core 1 and the coil 2, which are heating elements, so as to go up towards the upper part of the tank 3 from the lower part thereof due to natural convection, and the heat of the gas reaching the upper part of the tank is liberated to the atmosphere of a lower temperature through the surface of the tank 3. Usually, the surface area of the tank 3 is incremented through the waveform rib 5 for the purpose of enhancing the efficiency of the heat liberation through the tank 3. Then, the temperature of the $N_2$ gas 4, which heat is liberated to the atmosphere, lowers, which gas results in going down to the lower part of the tank 3. In this way, the convection of the gas 4 causes the heat generated in the iron core 1 and the coil 2 to be liberated to the atmosphere.

The cooling performance of the gas largely depends upon a heat transmission rate, which rate indicates the facility of heat being transmitted from the iron core 1 and the coil 2 to the $N_2$ gas 4, and upon the multiplication of a specific heat of the gas with a density thereof that represents a calorie required for increasing the temperature of the $N_2$ gas 4 per unit mass by one degree Centigrade when the $N_2$ gas deprives heat from the iron core 1 and the coil 2. The larger the heat transmission rate and the multiplication of the specific heat with the density become, the better the cooling performance becomes. Thus, in order to reduce the kinematic viscosity of the gas and to enlarge the density thereof so as to improve the cooling performance thereof, the prior $SF_6$ gas sealed insulation transformer is arranged such that the $SF_6$ gas is subjected to the application of high pressure.

On the other hand, the development and research of a lower loss material for the iron core as well as the progress of the production technology thereof allows the loss characteristics of the transformer to be remarkably of a lower loss than the prior counterparts For instance, as known, the iron loss of an iron core made of an amorphous metallic thin band that is a lower loss material is approximately one-fifth as large as the prior counterparts. The transformer possessed with the loss characteristics as defined in JEM (The Japan Electric Manufacturer's Association) 1474 is described below as a representative of a high-efficient transformer.

A so-called high-efficient transformer, the material for the iron core of which transformer is selected from one of a magnetic domain control silicone steel band, a silicone steel band and an amorphous alloy (an amorphous magnetic alloy), is intended for reducing the no-load losses of the iron core and for abating the load losses of the coil by the change of the material thereof or by the realization of a lower loss structure thereof so as to reduce the total loss of the transformer by 25% in comparison with that of the counterpart designated as JIS C4304 (1999). The adoption of the iron core and the coil possessed with the above loss characteristics into the gas insulation transformer allows the total loss thereof to reduce by approximately 25% less than the prior art, which leads to the abatement of the load generated by refrigeration. The prior issues as mentioned above are solved by the gas insulation transformer of the present invention, which transformer is provided with an iron core and a coil possessed with the loss characteristics of the high-efficient transformer as mentioned above.

Hereafter, the cooling mechanism and operation of the transformer are described in more details.

Figure 2:
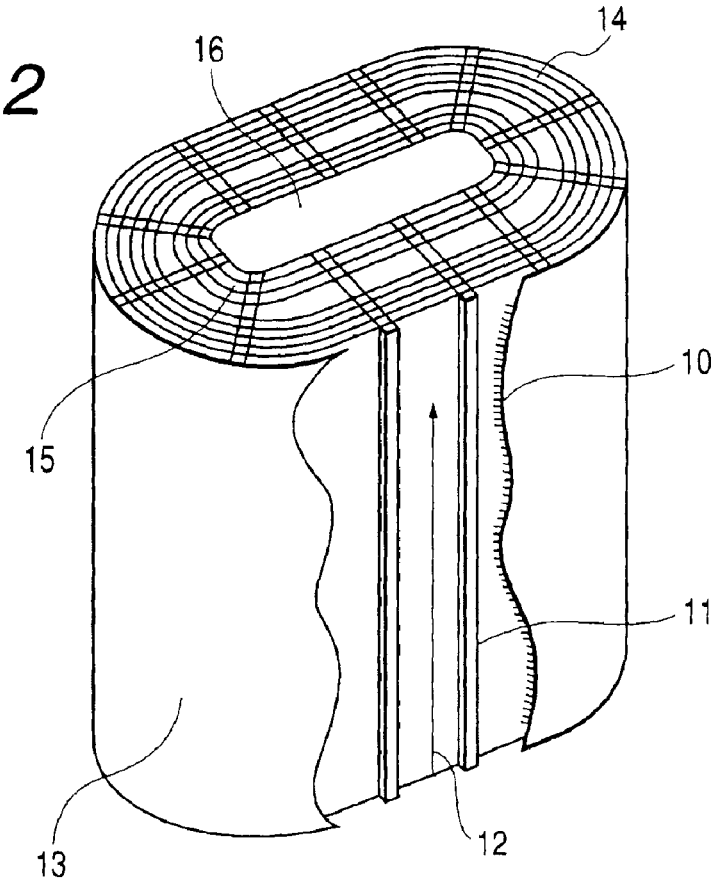
FIG. 2 is a perspective view of a coil incorporated in the gas insulation transformer as shown in FIG. 1, which coil is one example of the present invention.

FIG. 2 is a perspective view of a coil to be used for the gas insulation transformer as shown in FIG. 1, which coil is one example of the present invention. As shown in the drawing, a flat type or round conductor 10 is wound around a coil, between the adjacent strata of which a duct 11 is inserted so as to form a gas passage 12. Reference numeral 13 indicates an insulating paper wound for the insulation between the adjacent strata as well as between a first coil 14 and a second coil 15. Reference numeral 16 indicates an aperture into which the iron core 1 is inserted.

Figure 3:
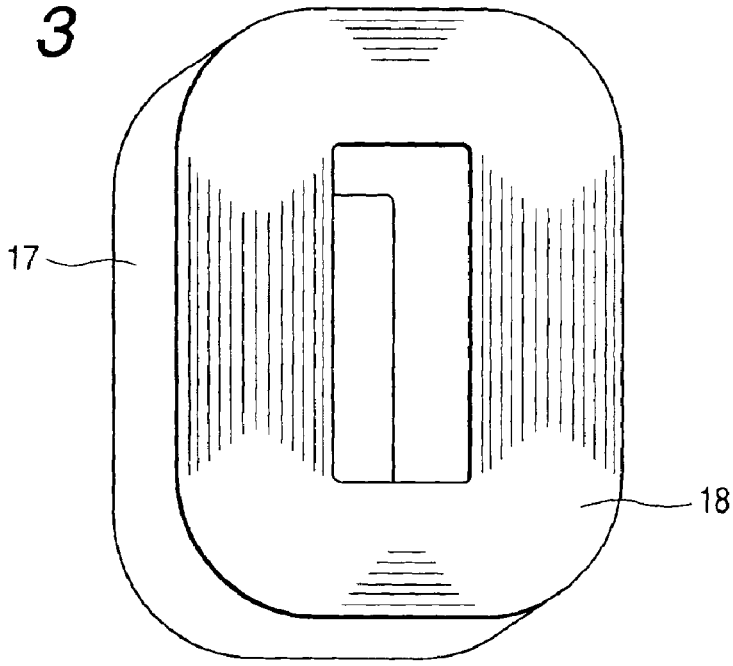
FIG. 3 is a perspective view of an iron core incorporated in the gas insulation transformer as shown in FIG. 1, which core is one example of the present invention.
Figure 4:
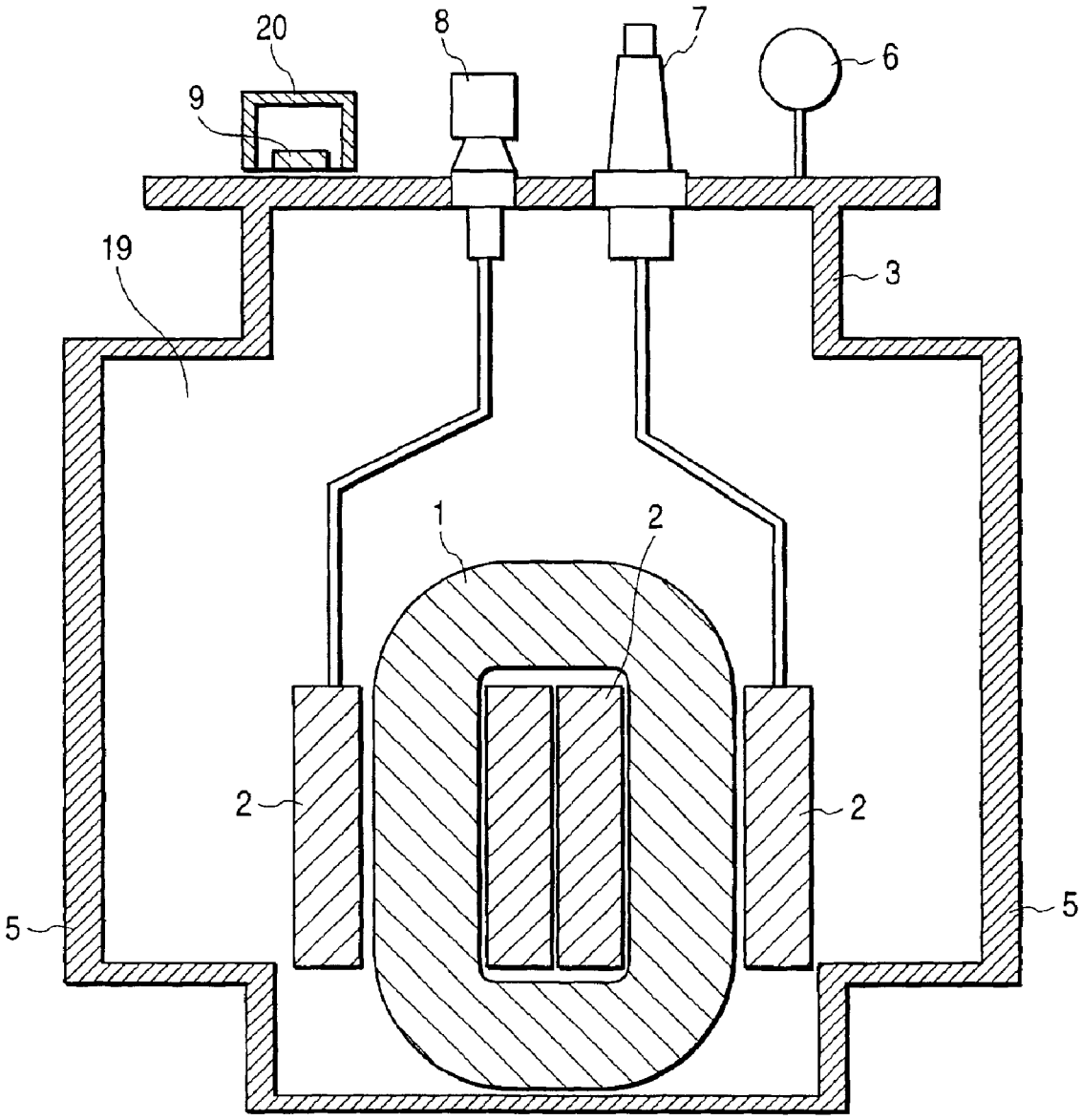
FIG. 4 is a partly sectional side view of the prior gas insulation transformer.

FIG. 3 is a perspective view of an iron core to be used for the gas insulation transformer as shown in FIG. 1, which iron core is one example of the present invention. In this example, an amorphous metallic thin band is adopted for the material for the iron core. A coating operation is performed on neither a flat surface portion thereof 17 nor a lamination surface thereof 18. The iron core 1 is inserted into the aperture 16 of the coil 2. The state where the iron core 1 is inserted into the coil 2 is shown in FIG. 1.

The $N_2$ gas 4 filled in a tank 3 generates natural convection through the heating of the iron core 1 and the coil 2, which are heating elements, and through heat liberation from the tank 3. The heat of the iron coil 1 is transmitted from a surface thereof not covered with the coil 2 to the $N_2$ gas 4. The heat of the coil 2 is transmitted from an outer surface thereof and an internal area thereof facing the gas passage 12 to the $N_2$ gas 4. The $N_2$ gas 4 flowing along the surface of the iron core 1 and through the gas passage 12 generates convection from the lower part of the coil 12 towards the upper part thereof, which gas flows upwards through the tank 3. The heat of the $N_2$ gas 4 is liberated from the surface of the tank 3 to the atmosphere. Usually, the surface area of the tank 3 is enlarged by the provision of a waveform rib 5, which rib helps the heat liberation of the tank 3 to improve. The heat liberation of the $N_2$ gas to the atmosphere leads to lowering the temperature thereof, which gas flows downwards through the tank 3. The convection of the $N_2$ gas as mentioned above refrigerates the iron core 1 and the coil 2.

The adoption of the iron core 1 and the coil 2, which are heating elements, possessed with the loss characteristics equivalent to that of a high-efficient transformer allows the load charged with refrigeration to abate. Thus, even if the $N_2$ gas 4, the multiplication of the specific heat with the density of which gas is approximately one-third as large as that of the $SF_6$ gas 19, is put to use, it allows the applied pressure of the gas to be less than 0.2975 Mpa (2 kg/cm$^2$G), which pressure is not subject to the restriction for the second-class pressure vessel. Further, it is not required to increase the applied pressure of the sealed gas so as to improve refrigeration, just provided that the width of the duct 11 disposed in the coil 2 is adjusted so as to adjust the gas volume flowing through the gas passage 12 and the number of the waveform ribs 5 is arranged in a proper manner, with the result that the cooling performance of the sealed gas is satisfied just by sealing the gas in the tank, to which gas is applied a pressure, e.g., amounting to 150.358 kPa or below to an extent that it avoids generating negative pressure inside the tank 3 owing to temperature change therein so as to restrain the atmosphere from invading therein.

The insulating performance of the sealed gas is reported in the literature ED-98-175 edited by the Discharge Research Institute, for instance. The result of this research is shown in FIG. 5.

Figure 5:
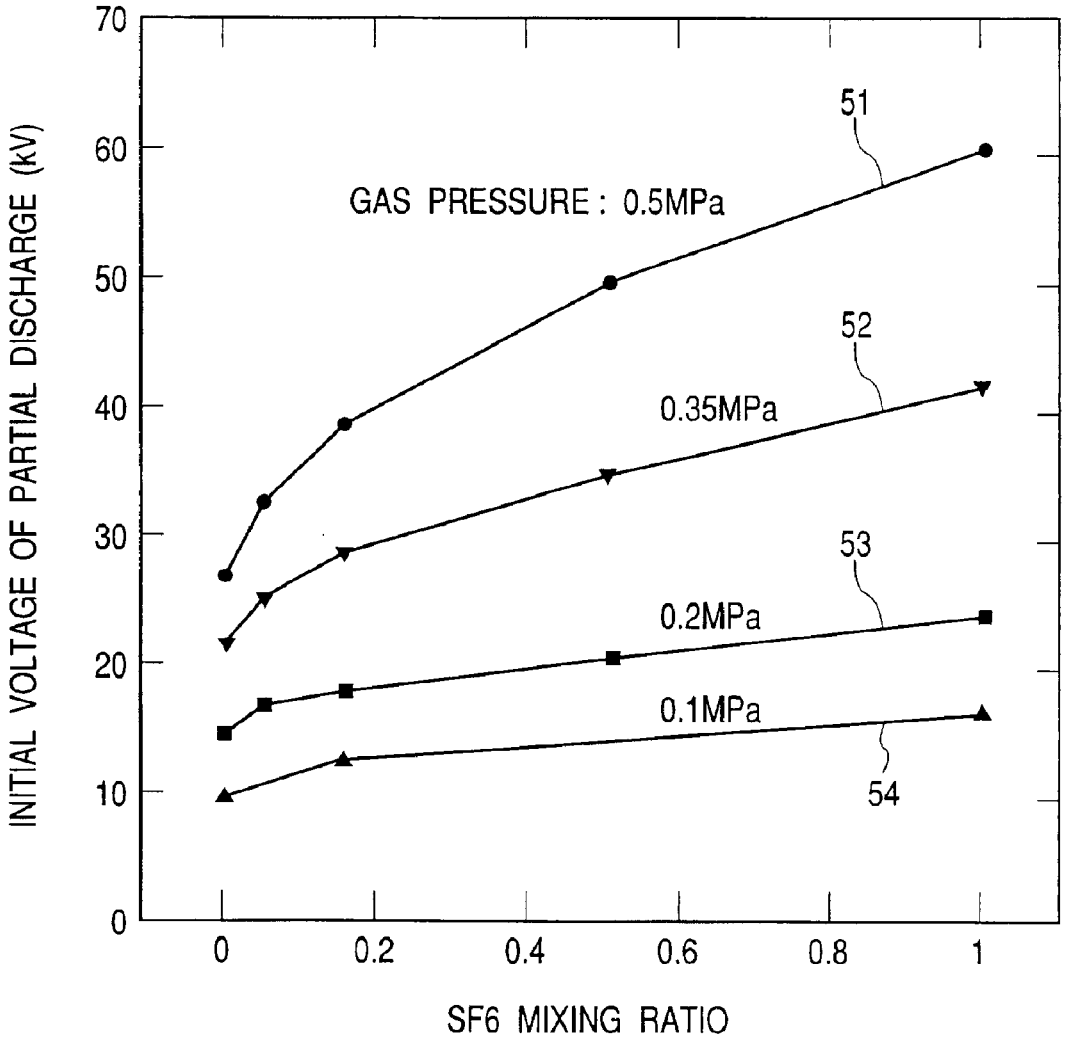
FIG. 5 is a diagram to show the relation between an initial voltage of partial discharge and the mixing ratio of sulfur hexafuloride to nitrogen gas.

FIG. 5 is a diagram to show the relation between the mixing ratio of sulfur hexafluoride to nitrogen gas and an initial voltage of partial discharge, the horizontal axis of which diagram shows the mixing ratio of $SF_6$ gas to $N_2$ gas while the vertical axis of which shows an initial voltage of partial discharge (kV). To note, the mixing ratio at 0 indicates that $N_2$ gas occupies 100% with no content of $SF_6$ while the mixing ratio at 1 indicating that $SF_6$ occupies 100% with no content of $N_2$.

The measurement of the initial voltage of partial discharge (kV) is carried out by disposing what is arranged with a slot wedge formed by disposing a high-voltage electrode, around which an insulating paper or a kraft paper is wound, opposedly with regard to an earthing electrode inside a tank, into which a gas or a mixed gas is sealed, and by providing a terminal of the high-voltage electrode and that of the earthing electrode outside the tank so as to apply voltage between those terminals and to measure a voltage, at which partial discharge or corona discharge is initiated. The above measurement takes the mixing ratio of $SF_6$ gas to $N_2$ gas ($SF_6/N_2$) as a parameter.

The curves 51 and 52 show a gas pressure at 0.5 Mpa and at 0.35 Mpa respectively while the curves 53 and 54 show a gas pressure at 0.2 Mpa and at 0.1 Mpa respectively.

The diagram as shown in FIG. 5 at the curve 54 under the application of the pressure of 0.1 Mpa indicates that the initial voltage of partial discharge from the kraft paper within the range of the mixing ratio of the $N_2$ gas to the $SF_6$ gas is rated at approximately 16 kV with no content of the $N_2$ gas while being rated at approximately 10 kV with no content of the $SF_6$ gas. Accordingly, it shows that the dielectric strength of the $N_2$ gas is 0.63 times as large as that of the $SF_6$ gas. The $SF_6$ sealed insulation transformer is designed with sufficient precaution that it never occurs breakdown even if the gas leaks so as to equate the gas pressure inside the tank with the atmospheric pressure. Thus, the deterioration of the dielectric strength in the order of 0.63 times as large as that of the $SF_6$ gas, does not invite breakdown with such a design change as adjusting the height of the duct 11 even when the $N_2$ gas 4 is sealed in the tank under the application of pressure to an extent that it prevents the atmosphere from invading therein.

The above operation also applies to any one of carbon dioxide, dried air and a mixed gas of those gasses with nitrogen gas that is used as an insulating and cooling medium. To note, the molecular weight of $N_2$ amounts to 28.01 while that of $CO_2$ amounting to 44.01.

The high-efficient transformer according to the present invention that reduces the no-load losses of the iron core and the load losses of the coil allows an inert gas, the global warming coefficient of which is rated 1 or below, to be used for insulation and refrigeration. The leakage of such inert gas as mentioned above into the atmosphere affects the global environment in the least degree.

As described above, even when $N_2$ gas 4 sealed in the tank 3 of the gas insulation transformer according to the present invention is discharged upon the inspection or demolition thereof, the gas is not subject to discharge restriction for greenhouse effect gasses so as to affect the global environment in the least degree. It neither causes the generation of a hazardous dissolved gas, which dispenses with the provision of an absorbent of the dissolved gas, nor is required to structure the tank sturdy or to provide a depressurizing tank 20 therewith as a countermeasure against the gas leakage that might be caused by the sudden increase of the internal pressure owing to the internal mishaps.

Then, the application of pressure for improving the insulating and cooling performance of the sealed gas does not have to be taken into account for strengthening the tank 3, as the $N_2$ gas is applied pressure to be sealed in the tank 3 to an extent that it prevents the atmosphere from invading therein, which tank only has to be strong enough to sustain an internal pressure change owing to the gas temperature rise as standardized in JEC (STANDARD OF THE JAPANESE ELECTROTECHNICAL COMMITTEE)-2200 and so forth.

In view of the foregoing, the tank of the gas insulation transformer according to the present invention is producible with a thinner steel plate than that of the $SF_6$ gas sealed tank. Then, the iron core 1 of the gas insulation transformer embodied in the present invention does not act as a catalytic metal to dissolve the sealed gas in the same way as the prior $SF_6$ gas sealed insulation transformer, which dispenses with a coating operation.

Further, an inert gas, the global warming coefficient of which gas is rated 1 or below, is sealed as an insulating and cooling medium in the tank 3 of the gas insulation transformer according to the present invention, which gas affects the global environment in the least degree. Then, the insulating gas is applied pressure to be sealed in the tank to an extent that the inside of the tank is not negatively pressurized owing to temperature change, which does not require the tank to be structured sturdy and reduces the weight of the transformer as well as the production cost thereof.

As described above, the leakage of the sealed gas to the atmosphere from the transformer according to the present invention, the global warming coefficient of which gas is rated 1 or below, affects the global environment in the least degree.

Then, the insulating gas is applied pressure to be sealed in the tank to an extent that the inside thereof is not negatively pressurized according to temperature change, which does not require the tank to be structured sturdy so as to reduce the weight of the transformer as well as the production cost thereof.

Further, a coating operation does not have to be performed on the iron core of the gas insulation transformer, in the tank of which $N_2$ gas is sealed, which reduces the number of the production steps thereof.

Likewise, it does not cause the generation of a hazardous dissolved gas, which dispenses with the provision of the depressurizing tank so as to reduce the weight of the gas insulation transformer as well as the production cost thereof.

The present invention may be embodied in other specific forms without departing from the sprit or essential characteristics thereof. The present embodiment is therefore to be considered in all respects as illustrative and not restrictive, the scope of the invention being indicated by the appended patent claims rather than by the foregoing description and all changes that come within the meaning and range of equivalency of the claims are therefore intended to be embraced therein.

What is claimed is:

1. A self-cooled gas insulation transformer comprising an apparatus including an iron core and a coil that is wound around said iron core, a tank to receive said apparatus therein and an inert gas that is filled in said tank as an insulating and cooling medium, wherein a global warming coefficient of said inert gas is rated 1 or below, and wherein said iron core is made of a material selected from a magnetic control silicone steel, a silicone steel of high orientation, and an amorphous alloy, and wherein said gas is applied pressure at less than 0.2975 Mpa (2 $kg/cm^2G$) to be sealed in said tank.

2. A self-cooled gas insulation transformer comprising an apparatus including an iron core and coil that is wound around said iron core, a tank to receive said apparatus therein and an inert gas that is filled in said tank as an insulating and cooling medium, wherein a global warming coefficient of said inert gas is rated 1 or below, and wherein said iron core is made of a material selected from a magnetic domain control silicone steel, a silicone steel of high orientation, and an amorphous alloy, and wherein said gas is applied pressure at 150.358 kPa or below so as to be sealed in said tank.

* * * * *